United States Patent [19]

Schmoeger et al.

[11] Patent Number: 4,807,528

[45] Date of Patent: Feb. 28, 1989

[54] OFFSET PREVENTION MEANS FOR PRINTING PRESSES

[75] Inventors: Duane A. Schmoeger, Cary; Robert T. Neece, Raleigh, both of N.C.

[73] Assignee: Airtech Company, Inc., Cary, N.C.

[21] Appl. No.: 60,220

[22] Filed: Jun. 10, 1987

[51] Int. Cl.[4] ..... B41F 23/06

[52] U.S. Cl. ..... 101/424.2; 118/674

[58] Field of Search ..... 101/416 B, 416 R, 416 A; 118/674

[56] References Cited

U.S. PATENT DOCUMENTS

| | | | |
|---|---|---|---|
| 3,550,552 | 12/1970 | Archibald et al. | 118/7 |
| 3,916,790 | 11/1975 | Alix | 101/232 |
| 3,931,787 | 1/1976 | Kuttner et al. | 118/8 |
| 4,198,907 | 4/1980 | Switall | 101/147 |
| 4,211,258 | 7/1980 | Switall | 137/862 |
| 4,332,198 | 6/1982 | Schmoeger | 101/416 B |
| 4,431,690 | 2/1984 | Matt et al. | 427/424 |
| 4,500,937 | 2/1985 | Matt | 361/153 |
| 4,530,862 | 7/1985 | Kerzel | 427/445 |

FOREIGN PATENT DOCUMENTS

| | | | |
|---|---|---|---|
| 2637875 | 3/1978 | Fed. Rep. of Germany | 101/416 |

*Primary Examiner*—Edgar S. Burr
*Assistant Examiner*—James Lisehora
*Attorney, Agent, or Firm*—Bell, Seltzer, Park & Gibson

[57] ABSTRACT

Freshly printed sheets are sprayed with antioffset material while being transported from the printing station to the sheet stacking station of a printing press. The control circuitry for the spray apparatus includes a sensor for detecting and signalling the location of successive ones of the sheets, and timers whose timing periods determine when each cycle of operation of the spray apparatus is initiated and terminated. The time periods are manually adjustable by potentiometers associated with the timers, and are automatically and compensatingly adjusted in response to changes in the press speed. Operation of an air compressor component of the spraying apparatus terminates automatically after spraying of the final printed sheet of a press run.

7 Claims, 1 Drawing Sheet

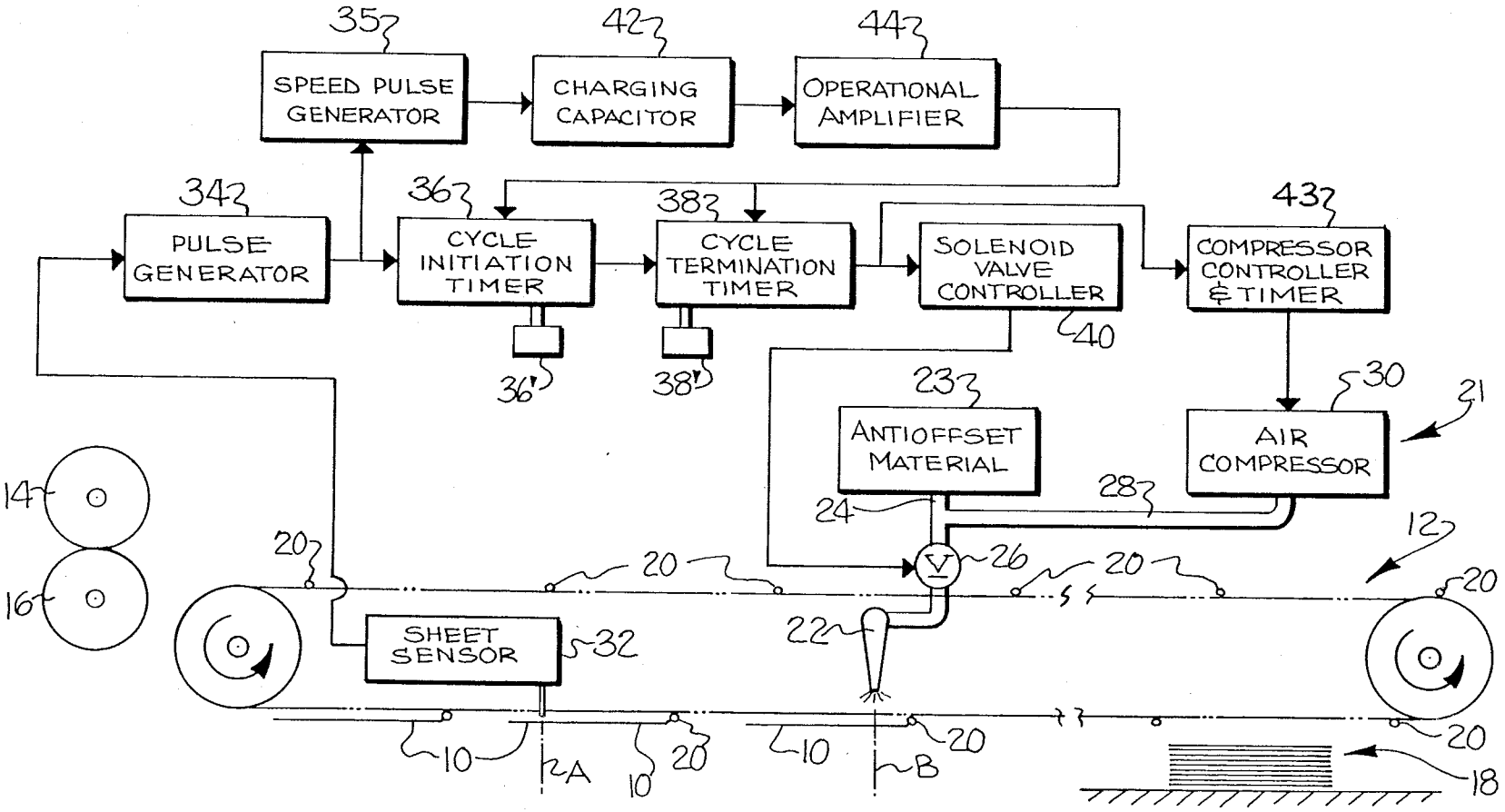
COMPRESSOR CONTROLLER & TIMER
AIR COMPRESSOR
SOLENOID VALVE CONTROLLER
ANTIOFFSET MATERIAL
OPERATIONAL AMPLIFIER
CHARGING CAPACITOR
CYCLE TERMINATION TIMER
CYCLE INITIATION TIMER
SPEED PULSE GENERATOR
PULSE GENERATOR
SHEET SENSOR
43
30
31
12
20
18
28
40
23
26
24
22
44
42
38
38'
36
36'
35
34
32
B
A
10
14
16

OFFSET PREVENTION MEANS FOR PRINTING PRESSES

FIELD OF THE INVENTION

This invention relates to the means employed in printing presses for preventing ink transfer or "offset" between freshly printed sheets transported to the stacking station or other output area of a printing press. The invention more specifically relates to an improved control system for an offset prevention means.

BACKGROUND OF THE INVENTION

Offset prevention means for printing presses are in general use and are disclosed in, e.g., U.S. Pat. Nos. 3,550,552 and 4,332,198. Such means customarily includes a spray assembly that dispenses antioffset material, usually in powder form, upon the freshly printed sheets passing from the impression roll to the stacking station of a printing press. The offset prevention means may further include an electrical control system for regulating the cycles of material-spraying operation of the spray assembly such that the material will be dispensed only when it will impact upon a freshly printed sheet, and not when it would pass between successive sheets. A deficiency of the existing control systems is that this desired result will automatically ensue only for as long as the press speed remains constant. If the press speed is changed the control system must be manually readjusted. In addition to being time consuming, such readjustment may be overlooked by the press operator, in which event antioffset material will not be sprayed upon all desired sheet portions and/or will be sprayed into the spaces between adjacent sheets. Either of these results is highly undesirable.

SUMMARY OF THE INVENTION

With the foregoing in mind, the present invention provides inexpensive but highly reliable control means by which the operation of an antioffset material sprayer of the hereinbefore noted type is adjusted automatically in response to, and in a manner compensating for, changes in the speed of operation of the printing press. In a preferred embodiment thereof, the control means of the invention includes a sheet location indicating means that generates electrical trigger signals indicative of the arrival of each of the freshly printed sheets at some preselected location along the path of travel thereof upstream from the spray nozzle that dispenses the antioffset material. The trigger signals are converted by a pulse generator into pulse signals that are received by primary electrical control means that includes a pair of adjustable timing devices whose timing periods respectively determine when each cycle of operation of the antioffset material sprayer is initiated and when it is terminated. Another set of the pulse signals is directed from the aforesaid pulse generator to a fixed pulse generator that generates synchronous pulses of fixed duration. Integrator means, preferably in the form of a capacitor and an operational amplifier, convert the aforesaid pulses into a control voltage signal that is inversely proportional to the pulse frequency and therefore to the press speed. The control voltage signal is continously transmitted to the first and second timing devices and, in response to speed changes of the printing press, effects inversely proportional compensating changes in the durations of the time periods of the devices. When the means for spraying the antioffset material is of a pneumatic type including an air compressor, as is frequently the case, the control system of the present invention preferably further includes means for effecting automatic termination of compressor operation after expiration of a time interval sufficient for passage of the last printed sheet through the location at which antioffset material is sprayed thereon.

DESCRIPTION OF THE PRIOR ART

In addition to those previously cited herein, the following U.S. patents may also be of interest in connection with the subject invention: U.S. Pat. Nos. 3,916,790, 4,198,907, 4,211,258 and 4,500,937.

BRIEF DESCRIPTION OF THE DRAWING

Other features of the invention will be apparent from the following description of an illustrative embodiment thereof, which should be read in conjunction with the accompanying drawing in which the single FIG. 1 is a diagrammatic and schematic representation of control and other components of printing press offset preventing means in accordance with the invention, some press components also being schematically shown.

DESCRIPTION OF THE PREFERRED EMBODIMENT

Referring now more particularly to the drawing, the numerals 10 designate freshly printed sheets being conveyed by the sheet delivery mechanism 12 of a printing press from its printing station, schematically represented by blanket and impression rolls 14, 16, to its sheet stacking or collection station 18. The delivery mechanism 12 is illustratively of a known endless-chain type having spaced gripper bars 20 that grasp the leading edge portions of successive ones of the sheets 10 passing from rolls 14, 16, and that release such sheets at stacking station 18. However, sheet delivery means of some other type might be employed in lieu of that shown.

To minimize the possibility of ink transfer or "offset" occurring between the freshly printed sheets at stacking station 18, a material spraying apparatus or means 21 sprays antioffset material powder upon sheets 10 as they are transported by mechanism 12 to the stacking station. Apparatus 21 includes a material dispensing nozzle 22 located in adjacent overlying relationship to the path traveled by sheets 10 between rolls 14, 16 and stacking station 18. Nozzle 22 is connected to a hopper 23 or other suitable source of antioffset material by a conduit 24 containing an electrically actuable valve 26. A branch conduit 28 also connects nozzle 22 with an air compressor 30. Antioffset material from hopper 23 is sprayed from nozzle 22 whenever compressor 30 is operating and valve 26 is open. Closure of valve 26 terminates material-spraying operation of spray apparatus 21, even though compressed air will continue to be directed to conduit 24 for as long as compressor 30 is energized.

The operation of spray apparatus 21 is regulated by adjustable control components to be now described. Such components include a sensor 32 for directly or indirectly detecting and signalling the presence of the leading edge of each successive one of the traveling sheets 10 at some preselected location along the path of sheet travel. While the aforesaid location might be anywhere along the sheet path of travel, it illustratively is adjacent the upstream (in relation to the direction of sheet travel) end of sheet delivery mechanism 12. As schematically illustrated in the drawing, sensor 32 consists of a snap switch that is engageable with the leading edge of each sheet 10, and/or with some component of sheet delivery mechanism 12 movable in unison therewith. Upon each such engagement, sensor 32 transmits an electrical trigger signal to a pulse generator 34 forming part of the primary control means for apparatus 21.

In response to the electrical trigger signals transmitted to it from sensor 32, pulse generator 34 generates two sets of synchronous electrical pulses. One set of the pulses generated by pulse generator 34 is transmitted sequentially through electronic timers 36, 38 to a valve controller 40 that controls the operation of the valve 26 whose opening and closing respectively initiates and terminates each cycle of antioffset material spraying operation of apparatus 21. Potentiometers 36', 38' respectively associated with timers 36, 38 permit manual adjustment of the timing periods thereof. The duration of the timing period of timer 36 determines the delay that transpires between actuation of sheet location sensor 32 and commencement of a spray cycle of operation of apparatus 21. This delay compensates for the time required for the leading edge portion of each sheet 10 to travel from the indicated location A, wherein sensor 32 is actuated, to the location B wherein it is in vertical alignment with nozzle 22 of apparatus 21. Manual adjustment of the delay time period of timer 36, by means of its potentiometer 36', usually is required only when apparatus 21 and/or sensor 32 are initially installed, or when they are adjusted in a manner changing the distance between the locations A, B.

The timing period of the other timer 38 regulates the time of termination, and thus the duration, of each cycle of material-spraying operation of apparatus 21. Potentiometer 38' is used to manually and compensatingly adjust the aforesaid timing period and spray cycle duration when there is a change in the actual length of the sheets 10 being printed or, if it is desired to spray the antioffset material upon only a part of each of the sheets, in the "effective" length of the sheets.

The cycles of material-spraying operation of apparatus 21 would no longer be properly synchronized with the movement of the sheets 10 beneath sprayer nozzle 22 if the press speed were changed and there were no compensating change in the time delay periods of timers 36, 38. To avoid this highly undesirable result, means are provided for automatically adjusting the time periods of timers 36, 38 in response to, and in a manner compensating for, changes in the press speed. The aforesaid speed compensating control means includes a speed pulse generator 35 that receives the second set of pulses that are generated by pulse generator 34 in response to the trigger signals from sheet sensor 32. In response to its receipt from generator 34 of the aforesaid pulse signals, whose frequency is proportional to the press speed, pulse generator 35 generates and transmits fixed length electrical pulses at the same frequency to integrator means in the form of a charging capacitor 42 and an operational amplifier 44. After a brief period of time, such pulses charge the capacitor to a voltage that is proportional to the pulse frequency and therefore to the press speed. The capacitor charge constitutes an input to operational amplifier 44, which in response thereto transmits an inversely proportional control voltage signal to timers 36, 38. Such control signal does not alter the time periods of the timers as long as the press speed remains constant. In the event of a change in press speed, however, the control signal causes compensating change in the time periods of both timers. Thus, if the press speed should be doupled, the time period of timers 36, 38 would each be automatically halved. Similarly, if the press speed should be halved, the time period of timers 36, 38 would automatically be doubled.

The electrical control signals transmitted from timers 36, 38 to solenoid valve controller 40 are also transmitted to a compressor controller 43 that controls energization and deenergization of the motor (not shown) associated with air compressor 30. Controller 43 causes the compressor motor to remain energized during each cycle of material-spraying operation of sprayer 21, and for a preselected brief time period following termination of each such cycle of operation. The aforesaid time period is sufficiently long as to cause the compressor motor to be continuously actuated while printed sheets 10 are passing beneath the spray nozzle 22, but to be automatically deenergized when the last sheet in a press "run" has passed beneath the nozzle. The aforesaid automatic cessation of operation of the compressor contributes significantly to the compressor's useful life.

While a preferred embodiment of the invention has been specifically shown and described, this was for purposes of illustration only, and not for purposes of limitation, the scope of the invention being in accordance with the following claims.

We claim:

1. In combination with a printing press having sheet delivery means for conducting freshly printed sheets along a path of travel from a printing station to a sheet collection station of said press, and cyclically operable sheet sprayng means for spraying successive ones of the sheets moving along said path of travel with antioffset material, the improvement comprising:

sheet location indicating means for, preparatory to each cycle of operation of said sheet spraying means, generating an electrical trigger signal indicative of the location along said path of travel of one of said sheets;

primary electrical control means for, in response to each said trigger signal, causing the performance by said spraying means of a cycle of operation thereof, said primary control means including timer means having an adjustable timing period regulating the time of termination of each of the cycles of operation of said spraying means, manually adjustable means for effecting manual adjustment of the duration of said timing period, second timer means having an adjustable timing period regulating the time of institution of each of said cycles of operation of said spraying means, and manually adjustable means for effecting manual adjustment of said second-mentioned timing period;

and speed responsive control means for automatically adjusting both said first-mentioned timing period and said second-mentioned timing period in response to and in a manner compensating for the changes in the speed to said printing press, said speed responsive control means including pulse generating means for generating electrical pulses at a frequency proportional to the speed of said printing press, and integrator means for receiving said pulses and in response thereto directing control signals to said first and second timer means effective to adjust said timing periods thereof.

2. Apparatus as in claim 1, wherein said integrator means includes capacitor means for receiving said pulses and for producing a control voltage proportional to the pulse frequency, and operational amplifier means for receiving said control voltage and generating said control signals, said control signals being inversely proportional to said control voltage.

3. Apparatus as in claim 1, wherein said spraying means includes an air compressor, and further including air compressor control means for maintaining energization of said air compressor during each of said cycles of operation of said spraying means and during a preselected time period following termination of each of said cycles of operation.

4. Apparatus as in claim 1, wherein said speed responsive control means includes pulse generating means for generating electrical pulses at a frequency proportional to the speed of said printing press, capacitor means for receiving said pulses and for producing a control voltage proportional to the pulse frequency, and operational amplifier means for receiving said control voltage and in response thereto directing inversely proportional electrical control signals to said timer means.

5. In combination with a printing press having sheet delivery means for conducting freshly printed sheets along a path of travel from a printing station to a sheet collection station of said press, and cyclically operable sheet spraying means for spraying successive ones of the sheets moving along said path of travel with antioffset material, the improvement comprising:

sheet location indicating means for, preparatory to each cycle of operation of said sheet spraying means, generating an electrical trigger signal indicative of the location along said path of travel of one of said sheets, said sheet location indicating means comprising a switch element actuated by engagement with the leading edge portion of each successive one of said sheets;

primary electrical control means for, in response to each said trigger signal, causing the performance by said spraying means of a cycle of operation thereof, said primary control means including timer means having an adjustable timing period regulating the time of termination of each of the cycles of operation of said spraying means, and manually adjustable means for effecting manual adjustment of the duration of said timing period;

and speed responsive control means for automatically adjusting said timing period in response to and in a manner compensating for changes in the speed of said printing press, said speed responsive control means including pulse generating means for generating electrical pulses at a frequency proportional to the speed of said printing press, capacitor means for receiving said pulses and for producing a control voltage proportional to the pulse frequency, and operational amplifier means for receiving said control voltage and in response thereto directing inversely proportional electrical control signals to said timer means.

6. Apparatus as in claim 5, wherein said primary control means further includes second timer means having an adjustable timing period regulating the time of institution of said cycles of operation of said spraying means, said electrical control signals also being directed to said second-mentioned timer means.

7. Apparatus as in claim 5, wherein said spraying means includes an air compressor, and further including air compressor control means for maintaining energization of said air compressor during each of said cycles of operation of said spraying means and during a preselected time period following termination of each of said cycles of operation.

* * * * *